United States Patent [19]

Gentile

[11] Patent Number: 4,848,631

[45] Date of Patent: Jul. 18, 1989

[54] SLIDE BLOCK FEED APPARATUS FOR A PRESS UTILIZING AN OSCILLATING CAM

[76] Inventor: Joseph Gentile, 555 Epsilon Dr., Pittsburgh, Pa. 15238

[21] Appl. No.: 201,305

[22] Filed: May 27, 1988

Related U.S. Application Data

[63] Continuation of Ser. No. 848,981, Apr. 7, 1986, abandoned.

[51] Int. Cl.[4] ..... B65H 20/18

[52] U.S. Cl. ..... 226/141; 83/202; 226/158

[58] Field of Search ..... 74/30, 84 R, 96, 109; 83/202, 273; 226/137, 139, 141, 142, 147, 158, 162

[56] References Cited

U.S. PATENT DOCUMENTS

| | | | |
|---|---|---|---|
| 1,014,829 | 1/1912 | Lepper et al. | 226/141 |
| 1,309,662 | 7/1919 | Smith | 226/141 |
| 2,468,620 | 4/1949 | Gilbert et al. | 226/158 X |
| 2,624,575 | 1/1953 | Koch | 226/141 |
| 3,148,817 | 9/1964 | Lord | 226/137 |
| 3,758,011 | 9/1973 | Portmann | 226/142 |
| 4,218,004 | 8/1980 | Rouse | 226/158 X |
| 4,316,569 | 2/1982 | Gentile | 226/158 |
| 4,487,352 | 12/1984 | Paris | 226/142 |
| 4,552,294 | 11/1985 | Rotzler | 226/162 X |

*Primary Examiner*—Daniel P. Stodola

*Attorney, Agent, or Firm*—Reed, Smith, Shaw & McClay

[57] ABSTRACT

A cam shaft of a press feed having a first pair of cam surfaces is rotated at a preselected speed depending upon the speed of the press. Continuous rotation of the cam surfaces is converted to intermittent oscillating rotational movement of an output shaft through a preselected angle of rotation by a pair of cam followers. The cam followers are nonrotatably connected to an output shaft that is connected by an adjustable linkage mechanism to a slide block. The intermittent oscillating rotational movement of the output shaft is transmitted to the slide block to advance the slide block containing stock material such as a bar or wire through a preselected distance corresponding to a preselected feed length. The feed length is adjustable by changing the length of travel of the linkage mechanism with respect to the degree of rotation of the output shaft. The slide block moves horizontally through a preselected distance to feed a preselected amount of material, remains stationary during a first dwell period and releases the material, moves horizontally in the opposite direction back to the initial feed position, remains stationary for a second dwell period and engages the material for another feed cycle. The intermittent feeding operation of the slide block is coordinated with the operations of releasing the slide block and clamping the stock material with a separate material clamp for holding the material while it is released from the slide block.

10 Claims, 6 Drawing Sheets

SLIDE BLOCK FEED APPARATUS FOR A PRESS UTILIZING AN OSCILLATING CAM

This is a continuation of co-pending application Ser. No. 06/848,981 filed on Apr. 7, 1986, now abandoned.

BACKGROUND OF THE INVENTION

1. Field of the Invention

The present invention relates to apparatus for feeding stock material to press and, more particularly, to apparatus for feeding stock material by moving a slide block feed through a preselected distance.

2. Description of the Prior Art

It is the conventional practice in high speed automatic press operations to feed a preselected length of stock material from a coil to the dies of the press for punching, stamping, cutting or the like. The strip of stock material must be fed from the coil in timed relation with the press operation. The stock material is moved into a position between the dies by the feeding apparatus. After the press operation is completed, the feeding apparatus is actuated to advance another length of stock material to the press. The feeding of the stock material to the press must be coordinated with each press operation so that, prior to each operation, a new segment of stock material is moved into position relative to the dies of the press.

Typically, a high speed feeding apparatus for a power punch press utilizes feed rolls for feeding the stock. U.S. Pat. Nos. 4,133,216 and 4,138,913 are examples of one type of feeding apparatus in which the feed rolls are drivingly connected by a plurality of meshing gears to an input shaft which is drivingly connected to the punch press crankshaft. A drive utilizing a specific arrangement of cams and gears receives continuous, uniform rotation from the input shaft and converts the rotation to a noncontinuous step-by-step, intermittent rotational movement of the driven feed roll. With this arrangement, the feed rolls advance intermittently through a 360° rotational cycle. During the single dwell period of the rotational cycle, the driven feed roll is not rotated and the punching operation is carried out. After the punching operation is completed, the feed rolls are again incrementally advanced so that another preselected length of stock material is passed through the press.

U.S. Pat. Nos. 3,758,011 and 3,784,075 are examples of another type of incremental feed apparatus that converts continuous rotation of a drive shaft to contrarotating movement of the feed rolls. The drive shaft is connected through a pair of meshing gears to a level that is oscillated to and fro. The pivotal movement of the lever is transmitted to a shaft that is, in turn, coupled to the feed rolls. The oscillatory movement of the lever and shaft is transmitted to the feed rolls to generate contrarotating movement. The feed length can be changed by altering the amplitude of the contrarotating movement of the feed rolls. Synchronously with the contrarotating movement, the feed rolls move toward one another into a feed position and move away from one another into an idling position. These apparatus, however, require a complex arrangement for interconnecting the operations of feeding, clamping and releasing the feed rolls, which requires many component parts and necessitates increased maintenance and replacement of worn parts.

U.S. Pat. No. 4,316,569 provides an apparatus for intermittently feeding a work piece or stock material to a punch press by converting continuous rotation of a cam surface to oscillating rotational movement of a cam follower, which is transmitted through an adjustable linkage to advance the driven feed roll in contact with the stock material through a preselected angle of rotation corresponding to a preselected feed length. The feed length is adjustable by changing the length of travel of the linkage mechanism. The driven feed roll rotates from an initial position through a preselected angle in a first direction to feed a selected length of material, remains stationary during a first dwell period and is released from the material, rotates in the opposite direction back to its initial feed position, remains stationary for a second dwell period and engages the material for another feed cycle. The intermittent feeding operation is coordinated with the operations of feed roll release and stock material clamping.

All of these prior art feeding devices utilize feed rolls to move the stock material from a coil to the dies of a press. A problem arises, however, with using feed rolls when the stock being fed is a small-wire or bar. With flat stock, the feed rolls engage the stock along a line of contact with the pressure typically being distributed evenly across the entire line. When wire stock or small bar stock is fed, however, there is usually only one point of contact between the stock and the feed rolls. As a result, the pressure applied to the feed rolls tends to distort the shape of the wire or bar and can even extrude it. Since the length of stock material fed depends on the circumference of the feed roll, any distortion or extrusion of the wire or bar caused by the pressure of the feed rolls results in an inaccurate length of material being fed to the press. Of course, if less pressure is used, the feed rolls cannot grip the stock material sufficiently to advance it. Thus, there is a need for a press feeding mechanism which overcomes this distortion problem while at the same time being easily adjustable.

Sliding block press feeds are known in the art. A standard sliding block press feed operates by gripping the stock material and moving it forward into the press. When the sliding block reaches a stop block or the end of its mechanical linkage, the stock material is simultaneously released and the sliding block is returned for the next feeding cycle. Typically, these sliding block press feeds are operated in a timed sequence, with the sliding block timed to release the stock at the instant it reaches the stop block or the end of its mechanical linkage. Unless the timing is perfect, there will be error in determining the feed length since a premature or late release of the stock will result in the wrong feed length being fed to the press. Thus, there is a need for precisely controlling and rapidly changing the predetermined lengths of stock material fed to a press by a sliding block feed.

SUMMARY OF THE INVENTION

Generally, the present invention provides a press feed apparatus for intermittently feeding stock material by the reciprocating movement of a slide block through a preselected distance. The oscillating rotational movement of a slide block drive shaft moves a slide block through a preselected distance corresponding to a preselected feed length. The present invention also provides a cam driven press feed for intermittently feeding a selected length of stock material to a power actuated press in which the length of material fed for each press operation is adjustable by controlling the degree of angular movement of the slide block drive shaft. The present invention also provides that the intermittent feeding of a work piece or stock material to a press by a slide block can be operated synchronously with the operations of releasing the work piece from clamping engagement with the slide block and clamping the work piece with a separate material clamp.

The present invention generally provides an apparatus for intermittently feeding a work piece that includes a cam shaft supported for rotation at a continuous preselected speed related to the speed of a press. An output shaft has a first end portion and a second end portion. Cam drive means connect the cam shaft to the output shaft first end portion to generate an intermittent oscillating rotational movement of the output shaft through a fixed, preselected angle of rotation. A linkage mechanism is drivingly connected between the output shaft second end portion and a feed means. The linkage mechanism transmits the intermittent oscillating rotational movement of the output shaft to the feed means and thereby intermittently oscillates the feed means through a variable preselected horizontal distance. The feed means intermittently advances a preselected length of stock material into the press. The length of stock material fed corresponds to the horizontal displacement of the feed means.

The cam drive means includes at least one cam having two cam surfaces nonrotatably connected to the cam shaft. A cam follower rides on each cam surface and is nonrotatably connected to the first end portion of the output shaft. The cam continuously rotates with the cam shaft creating an intermittent oscillating rotational movement of the cam follower through a preselected angular path, for example, through a 60° arc. Thus, upon one complete rotation of the cam, each cam follower is rotated in a first direction through a preselected angle and is then rotated in the opposite direction back through the same preselected angle to the original starting position. At the end of each angle of rotation, each cam follower experiences a dwell period. During the dwell period, there is no transmission of rotation from the cam to the output shaft.

The intermittent oscillating rotational movement of the cam follower is transmitted by the output shaft to a transfer linkage or linkage mechanism which is connected between the output shaft and the feed means. The transfer linkage generates intermittent reciprocating horizontal movement of the feed means from the intermittent oscillating angular movement of the output shaft. The feed length is adjustable by changing the length of travel of the linkage mechanism.

Preferably, the feed means includes a slide block. The slide block, from an initial position, horizontally advances a work piece through a preselected distance. After the preselected length of material is fed to the press, a first dwell period occurs. During this dwell period, the work piece is released from engagement with the slide block to permit the slide block to return to its initial feed position and to permit final positioning of the work piece in the press if necessary. Also, during the first dwell period, the work piece is engaged by a separate material clamping mechanism that is operated synchronously with the feeding of the work piece and is also driven by the cam shaft.

After the first dwell period, rotational movement of the output shaft in the opposite direction returns the slide block to the initial feed position so that the intermittent feeding of the work piece may be repeated. A second dwell period follows the horizontal movement returning the slide block to its initial position. During the second dwell period, the work piece is returned to engagement with the slide block and the separate material clamping mechanism is released. The exact timing of the release and engagement of the slide block and the material clamp depends upon the size and shape of the stock material and the desired results.

In a preferred embodiment, the linkage mechanism connecting the output shaft to the feed means includes an adjustable throw block nonrotatably secured to the second end portion of the output shaft. The throw block is connected to the slide block drive shaft through a transfer arm and a gear train that includes a pair of gears or a plurality of meshing gears. Alternatively, the throw block can be connected directly to the slide block drive shaft through a transfer arm and connecting link. Fixed on the slide block drive shaft is a gear which meshes with a rack attached to the slide block. As the slide block drive shaft and gear rotate, the slide block moves horizontally.

The throw block includes a longitudinally moveable slide portion connected to an adjusting means which may be quickly adjusted, avoiding downtime of the machine. By rotating the adjusting means, preferably a screw, the slide portion is longitudinally moveable on the throw block to a preselected position. The length of travel of the linkage mechanism can be quickly adjusted by moving the slide portion to a preselected position on the transfer block to provide a preselected angular displacement of the slide block drive shaft. This, in turn, provides a preselected horizontal displacement of the slide block which results in a preselected feed length for a given angular rotation of the output shaft.

In another embodiment, the transfer linkage comprises a set of meshing gears for connecting the output shaft to the slide block drive shaft. By replacing one set of gears with another set having gears of different sizes, different feed lengths can be obtained. Since each different feed length requires a different set of gears, it is desirable to use the infinitely adjustable throw block linkage mechanism described above if many different feed lengths are required, thereby reducing the inventory of gears.

The slide block release mechanism and the material clamping mechanism are actuated by at least one cam having two cam surfaces that is nonrotatably attached to the cam shaft in a preselected angular position. The slide block release mechanism is actuated by a cam follower that adjustably engages a first surface of the cam. Similarly, the clamping mechanism is actuated by another cam follower that adjustably engages a second surface of the cam. The continuous rotation of the cam shaft and the cam surfaces causes the slide block to move out of and into engagement with the stock material synchronously with the movement of the material clamping mechanism and the intermittent feeding of the work piece. Both the slide block release mechanism and the material clamping mechanism are adjustable to compensate for different thicknesses of feed stock.

Other features and advances of the present invention will be apparent from the following detailed description and with reference to the accompanying drawings.

DESCRIPTION OF THE PREFERRED EMBODIMENT

Figure 1:
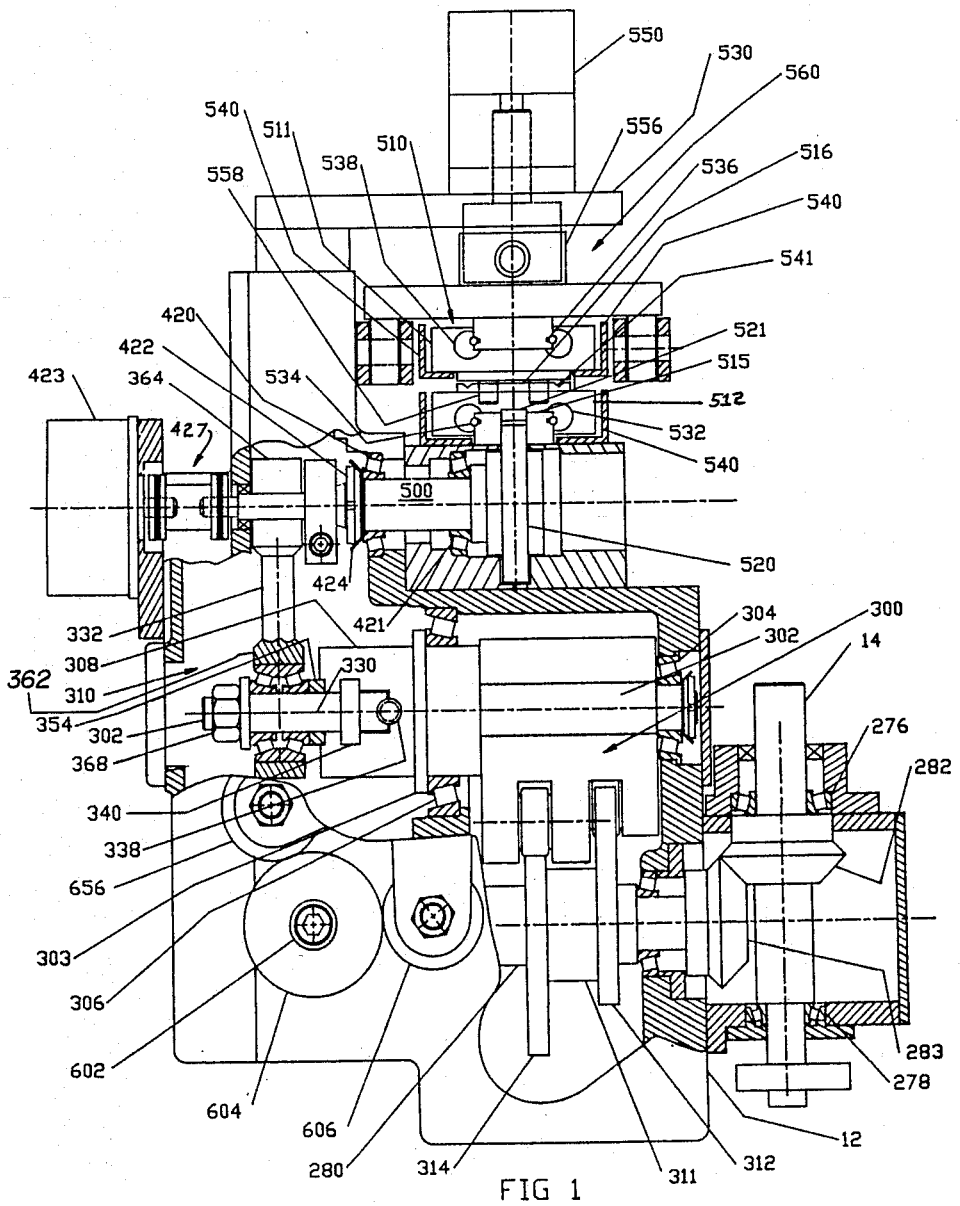
FIG. 1 is a partial sectional view of an embodiment of the slide block feeding apparatus for feed a preselected length of stock material.
Figure 2:
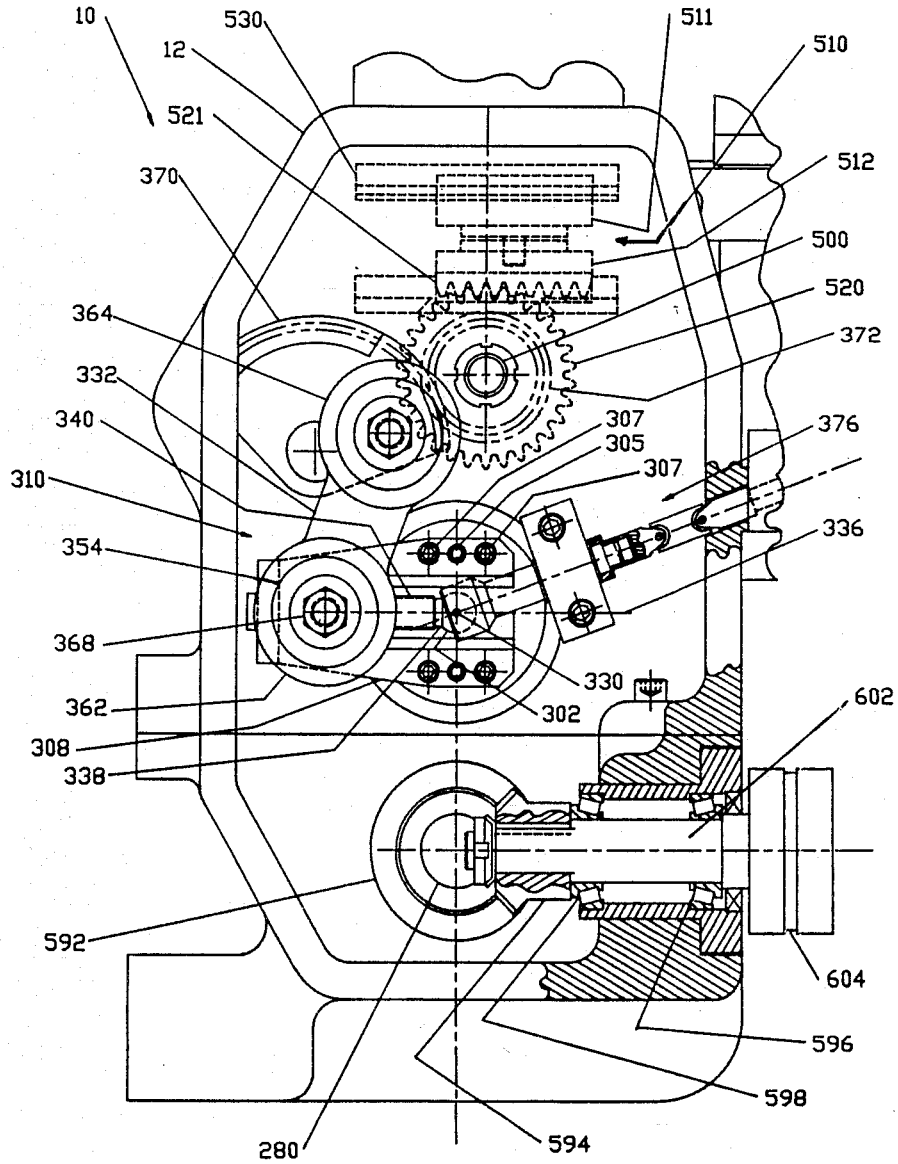
FIG. 2 is a side view of the embodiment shown in FIG. 1.

Referring to the drawings and particularly to FIGS. 1 and 2, there is illustrated a preferred embodiment, generally designted by the numeral 10, of the apparatus for intermittently feeding stock material or a work piece, such as a wire or a bar, to a press for stamping, forming or the like. Although apparatus 10 is designed specifically for overcoming problems associated with feeding wire or bar material, it is evident that apparatus 10 can be used for feeding any work piece, including any sheet material.

Apparatus 10 includes a suitable housing 12 and an input shaft 14 which extends partway through housing 12 and is supported for rotation therein. Input shaft 14 is drivingly connected to the crank shaft (not shown) of the press in a manner as illustrated in U.S. Pat No. 4,138,913. The rotation of the crank shaft is transmitted to input shaft 14 to rotate the input shaft at a continuous, preselected speed corresponding to the speed of the press.

Input shaft 14 is rotatably supported by conventional bearing assemblies generally designated by the numerals 276 and 278, respectively. A cam shaft 280 is positioned at a right angle with respect to input shaft 14 and is drivingly connected to input shaft 14 by a pair of meshing gears 282 and 283. Gear 282 is nonrotatably connected to input shaft 14, and gear 283 is nonrotatably connected to a first end portion of cam shaft 280. Cam shaft 280 is also rotatably supported in machine housing 12 by conventional bearing assemblies similar to bearing assemblies 276 and 278.

In accordance with the present invention, continuous rotation of input shaft 14 is transmitted through gears 282 and 283 to cam shaft 280 and then by a cam drive mechanism 300 and a transfer linkage or linkage mechanism 310 to a slide block drive shaft 500. Slide block drive shaft 500 and slide block 510 are operable, as will be explained in greater detail, to advance a preselected length of the stock material at a preselected speed to a press where the stock material is punched, stamped, cut or the like.

A top part 511 of slide block 510 is positioned in an overlying relation with a bottom part 512 of slide block 510 with the stock material placed between them. The continuous rotary motion of input shaft 14 and cam shaft 280 is converted by the cam drive mechanism 300 and linkage mechanism 310 into noncontinuous or intermittent oscillating rotary motion of slide block drive shaft 500 through a preselected angle of rotation to intermittently feed a preselected length of stock material to the press.

Figure 3:
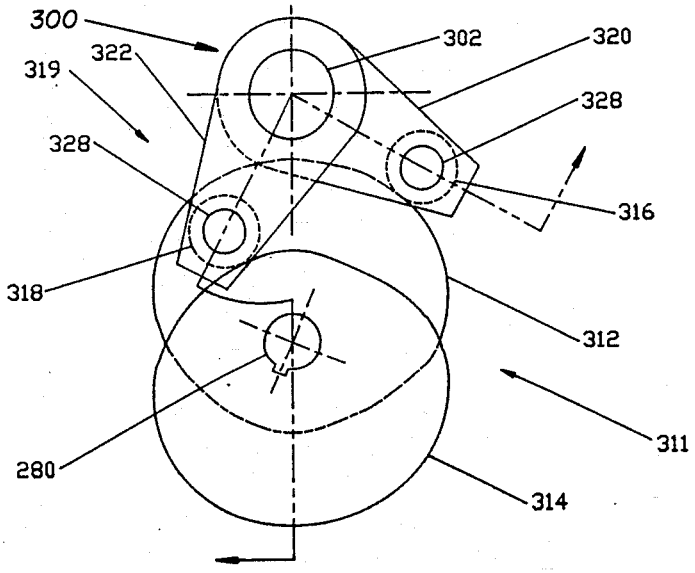
FIG. 3 is a fragmentary view in side elevation of the cam and cam follower arrangement for converting the continuous rotation of the cam shaft into the intermittent oscillating motion of the output shaft.
Figure 4:
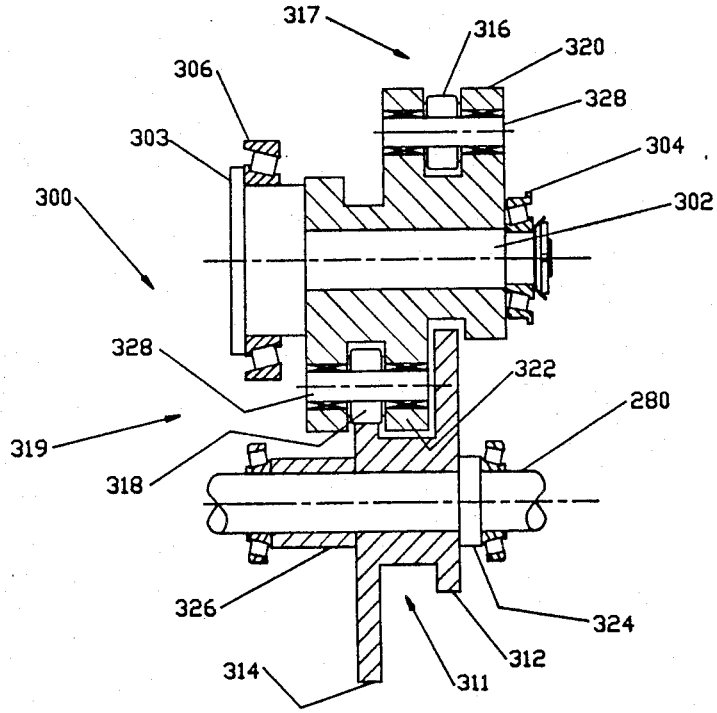
FIG. 4 is a side view of the cam and cam follower arrangement shown in FIG. 3.

Cam shaft 280 is continuously rotated at a preselected speed determined by the speed of the press. As shown in FIGS. 3 and 4, the continuous rotation of cam shaft 280 is converted by a cam drive mechanism 300 to intermittent oscillating rotational movement of an output shaft 302. Output shaft 302 is positioned in spaced parallel relation to cam shaft 280 and is rotatably supported in housing 12 at its end portions by conventional bearing assemblies 304 and 306.

Output shaft 302 includes an enlarged end portion 303 which is nonrotatably connected by a plurality of dowel pins 305 and cap screws 307 to a throw block 308 of a linkage mechanism 310 shown in FIG. 2. Linkage mechanism 310 is operable to transmit the intermittent oscillating movement of output shaft 302 to slide block drive shaft 500.

Cam drive mechanism 300, illustrated in FIGS. 3 and 4, includes a radial conjugate cam 311 with two cam surfaces 312 and 314 that are preloaded against a pair of followers 316 and 318 that are rotatably mounted on a pair of yoke members 320 and 322, respectively. Followers 316 and 318 and pin 328 together with yoke members 320 and 322 form cam followers 317 and 319. Cam surfaces 312 and 314 have a preselected configuration to convert the continuous rotation of cam shaft 280 into intermittent oscillating rotational movement of output shaft 302. Cam 311 is nonrotatably connected to an intermittent portion of cam shaft 280 and is maintained in a fixed axial position thereon by a shaft shoulder 324 and a cam spacer 326. Each of the followers 316 and 318 is mounted on a pin 328 which is rotatably retained in the respective yoke members 320 and 322 to permit rotation of followers 316 and 318 as they move on cam surfaces 312 and 314.

As illustrated in FIG. 3, yoke members 320 and 322 maintain followers 316 and 318 in contact with cam surfaces 312 and 314. Cam surfaces 312 and 314 have a corresponding configuration to generate intermittent oscillating rotational movement of yoke members 320 and 322 and, as a result, intermittently oscillate output shaft 302 through a preselected angle of rotation. As followers 316 and 318 follow cam surfaces 312 and 314 during the first part of one revolution of cam shaft 280, yoke members 320 and 322 and thus cam followers 317 and 319 rotate from an initial position through a preselected angle as, for example, an angle of 60°.

Yoke members 320 and 322 and output shaft 302 then stop during a first dwell period while cam 311 and cam surfaces 312 and 314 continue to rotate and then resume rotation in the opposite direction through a corresponding angle as, for example, an angle of 60°. Yoke members 320 and 322 and output shaft 302 are thus returned to their initial starting position and are stopped during a second dwell period while cam 311 and cam surfaces 312 and 314 continue to rotate. Thus, yoke members 320 and 322 as well as cam followers 317 and 319 and output shaft 302 intermittently oscillate from an initial position through a preselected angle and then back through the same angle to the initial position for each revolution of cam 311 and cam surfaces 312 and 314.

As cam 311 and cam surfaces 312 and 314 continuously rotate, cam followers 317 and 319 and output shaft 302 oscillate back and forth through a preselected angle. At the end of each angle of rotation, cam followers 317 and 319 experience a dwell period in which yoke members 320 and 322 do not move. The cam feed mechanism is more particularly described in U.S. Pat. No. 4,316,569 which is incorporated herein by reference as if fully set forth.

The intermittent oscillating movement of output shaft 302 is transmitted by linkage mechanism 310 to slide block drive shaft 500. As illustrated in FIGS. 1 and 2, throw block 308 is nonrotatably connected at one end to an enlarged end portion 303 of output shaft 302. At its other end, throw block 308 supports first end portion 362 of transfer arm 332 for slideable movement of end portion 362 along an axis 336 of an adjusting means, preferably screw 338. The axis of adjusting screw 338 is transversely aligned with the axis of rotation of output shaft 302.

Throw block 308 has a longitudinally extending recessed portion 340 aligned with adjusting screw axis 336. End portion 362 of transfer arm 332 is longitudinally moveable in recessed portion 340. With this arrangement, adjusting screw 338 is rotatable relative to throw block 308 but is restrained from axial movement relative thereto. Upon rotation of adjusting screw 338 in a preselected direction, end portion 362 of transfer arm 332 moves longitudinally in recessed portion 340 to a preselected position on throw block 308 to adjust the amount of displacement transfer arm 332 undergoes and thereby adjust the length of material fed. The throw block, linkage mechanism and method of adjusting the length of material fed is more particularly described in U.S. Pat. No. 4,487,352 which is incorporated herein by reference as if fully set forth.

A second end portion 364 of transfer arm 332 is connected through a pair of meshing gears 370 and 372 to slide block drive shaft 500. Meshing gears 370 and 372 transmit any movement of transfer arm 332 to slide block drive shaft 500. Nonrotatably fixed to slide block drive shaft 500 is a gear 520 which meshes with a rack 521 that is fixed to the underside of slide block bottom part 512. Thus, the intermittent oscillating rotational movement of output shaft 302 is transmitted to slide block drive shaft 500 to reciprocatingly rotate it through a preselected angle. This causes slide block 510 to move horizontally for a preselected distance feeding a preselected length of the work piece to the press, and then move back to its initial position ready to feed another piece of material.

The length of travel of linkage mechanism 310 and specifically transfer arm 332 is adjustable to provide a preselected degree of rotation of slide block drive shaft 500 corresponding to a desired length of stock material to be fed. The length of travel of linkage mechanism 310, the degree of rotation of slide block drive shaft 500, the horizontal movement of slide block 510 and the resultant feed length increases with an increase in the distance between the connection of transfer arm end portion 362 on throw block 308 and the rotational axis 330 of output shaft 302, as illustrated in FIG. 2. When transfer arm end portion 362 overlies rotational axis 330 there will be no movement of linkage mechanism 310.

To make adjustments in the feed length, nut 368 is loosened on shaft threaded end 352 to thereby remove clamp bushing 354 from frictional engagement with the surface of throw block 308 in the recessed portion. Adjusting screw 338 is then rotated in a preselected direction on throw block 308 by an actuating device generally designated by the numeral 376 and described in U.S. Pat. No. 4,487,352 which has already been incorporated herein by reference.

The length of travel of linkage mechanism 310 is adjusted by adjusting the position of transfer arm end portion 362 on throw block 308. Adjusting screw 338 is rotated by actuating device 376 to adjust the position of transfer arm end portion 362 on throw block 308. Transfer arm end portion 362 is moved laterally to a preselected position on throw block 308 with respect to rotational axis 330 of output shaft 302. Once transfer arm end portion 362 has been moved to a preselected position on throw block 308 corresponding to a preselected feed length, nut 368 is tightened on threaded end 352 returning clamping bushing 354 to frictional engagement with throw block 308 to retain transfer arm end portion 362 in the selected position. This arrangement is infinitely adjustable and provides a very precise and easily obtained adjustment in the feed length.

Preferably, transfer arm end portion 364 is eccentrically connected adjacent to the periphery of gear segment 370. Although shown in FIG. 2 as a radial gear segment, it should be understood that the gear to which transfer arm 332 is connected may have gear teeth around its entire periphery.

Figure 5:
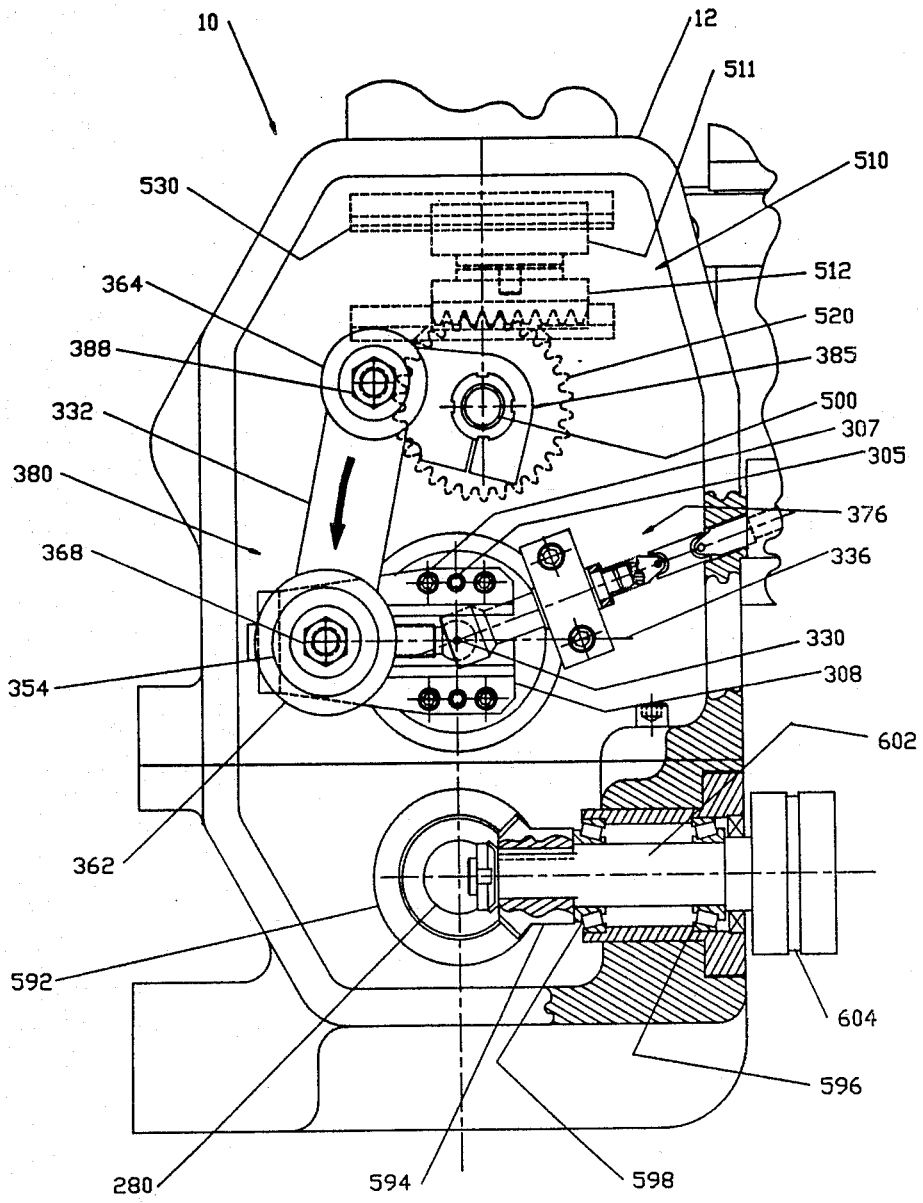
FIG. 5 is the same view as shown in FIG. 2 showing a different adjustable linkage mechanism between the output shaft and the slide block drive shaft.

Another embodiment of the present invention using a different linkage mechanism 380 is shown in FIG. 5. In FIG. 5, linkage mechanism 380 has replaced linkage mechanism 310 of FIG. 2. One will note that the two linkage mechanisms are basically the same except that gear segment 370 and gear 372 have been replaced by a connecting link 385. Both linkage mechanisms contain throw block 308, adjusting mechanism 376, transfer arm 332 and transfer arm end portions 362 and 364. In the embodiment shown in FIG. 5, however, transfer arm end portion 364 is pivotally connected by pin 388 to one end of link 385. The other end of connecting link 385 is nonrotatably connected to slide block drive shaft 500.

As output shaft 302 rotates, throw block 308 pivots pulling transfer arm end portion 362 in a generally downward direction as shown by the arrow in FIG. 5. Correspondingly, transfer arm end portion 364 is pulled in a generally downward direction which pulls connecting link 385 downward, thereby rotating slide block drive shaft 500. Linkage mechanism 380 then experiences a dwell period while output shaft 302 remains stationary.

Output shaft 302 then rotates back in the opposite direction, pivoting throw block 308 and moving transfer arm end portion 362 in a generally upward direction back to its original position as shown in FIG. 5. This pushes transfer arm end portion 364 in a generally upward direction returning it to its original position. It also pivots connecting link 385 and thereby rotates slide block drive shaft 500 in the opposite direction from its earlier movements. Linkage mechanism 380 then experiences a second dwell period while output shaft 302 remains stationary.

While two embodiments 310 and 380 of the linkage mechanism have been described, it is evident that other known linkage mechanisms may be used. For example, a set of four meshing gears may be used to connect output shaft 302 with slide block drive shaft 500. Such a set of meshing gears is described in U.S. Pat. Nos. 4,133,216 and 4,138,913 which are incorporated herein by reference as if fully set forth. By substituting different sets of gears, different feed lengths can be obtained.

As shown in FIG. 1, slide block drive shaft 500 is rotatably mounted by a pair of bearing assemblies generally designated by the numerals 420 and 421 in housing 12. Bearing assemblies 420 and 421 are retained in a preselected axial position on slide block drive shaft 500 by combination bearing nuts 422 and bearing washers 424. An optical encoder 423 is connected by coupling 427 to slide block drive shaft 500 to monitor its rotation and to send feedback signals to a system monitor (not shown).

Nonrotatably fixed on slide block drive shaft 500 is a gear 520 having gear teeth which intermesh with the gear teeth on a rack 521. Using known techniques, gear 520 can be adjusted to ensure a proper mesh between the gear teeth of gear 520 and rack 521. Rack 521 is attached by screws and/or bolts to the underside 515 of slide block bottom part 512 which is located above gear 520. As gear 520 rotates, slide block 510 moves horizontally within a housing 530.

Slide block top part 511 is located within housing 530 and is supported therein on slideable tracks 538 by bearings 536. Similarly, slide block bottom part 512 is supported on slideable tracks 532 by bearings 534. Oil catch pans 540 collect oil used to lubricate bearings 534 and 536 and prevent it from falling onto the stock material in slide block 510. If bearings 534 and 536 were lubricated in a different manner, oil catch pans 540 could be removed. It is evident that other bearings and methods of lubrication can be used to enable slide block 510 to easily move back and forth.

Slide block bottom part 512 is generally rectangular in shape with two V-shaped grooves 541 cut in upper surface 516 parallel to the direction in which the stock material is fed. If the stock material is wire 542 or bar 543, it is fed such that it rests within one of the grooves 541. Although two grooves are generally provided additional grooves could be provided to increase the capacity of the apparatus. The grooves prevent any unnecessary distortion or extrusion of the stock material when slide block top part 511 clamps the material in place. Although not shown in FIG. 1, slide block top part 511 may also have two grooves on its undersurface which correspond to grooves 541. It is also evident that grooves other than V-shaped can be used as half-round.

Figure 6:
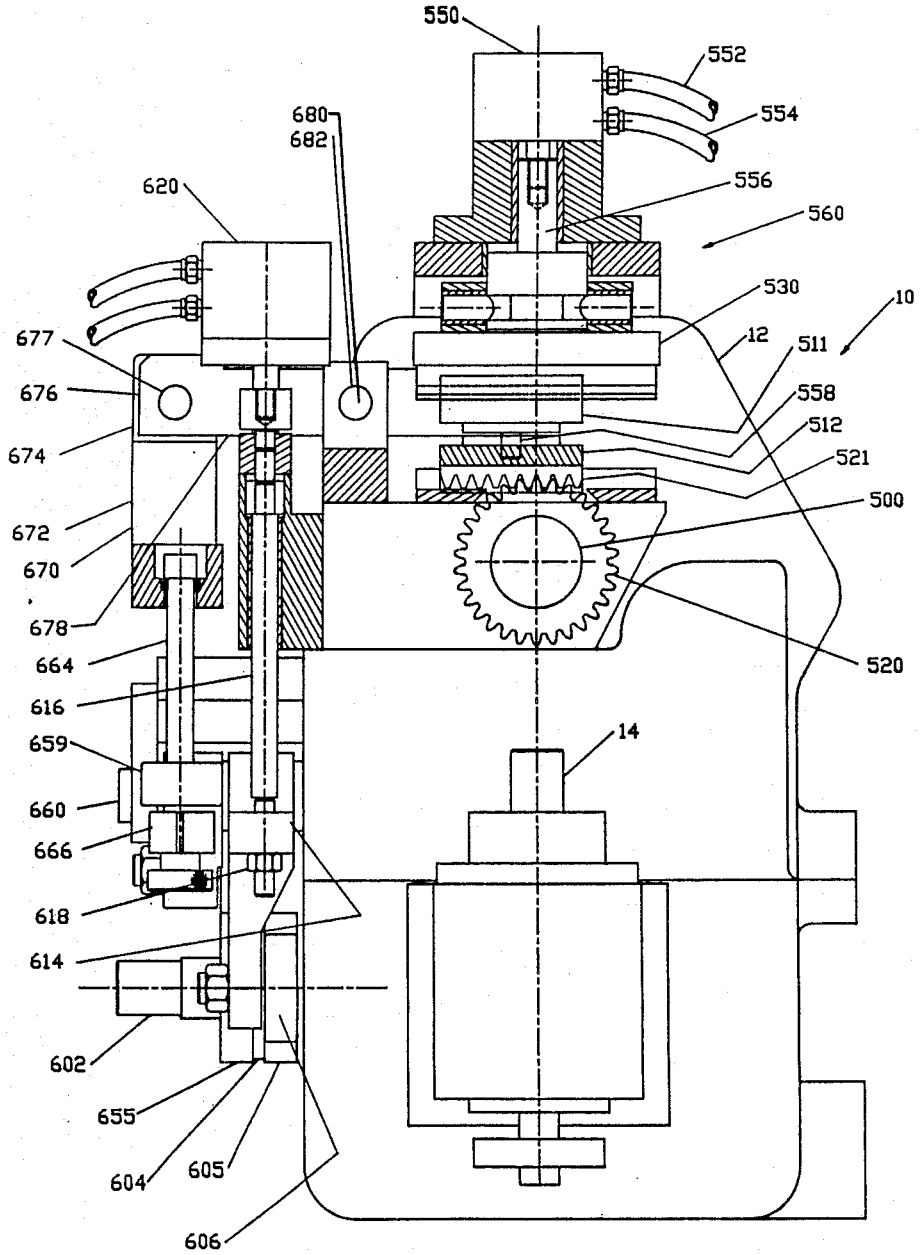
FIG. 6 is a side view of a preferred embodiment of the slide block feed apparatus showing a slide block release mechanism and a material clamp mechanism.

Compressed air cylinder 550 is situated at the top of apparatus 10 on holding 12 as shown in FIGS. 1 and 6. Compressed air cylinder 550 is a standard compressed air cylinder with inlet hose 552 and outlet hose 554. By increasing the pressure in compressed air cylinder 550, piston rod 556 is forced in a downward direction. Piston rod 556 is connected to housing 530 by a pivotable connection 560 whereby the downward movement of piston rod 556 causes a downward movement of housing 530. Housing 530 in turn is connected to slide block top part 511.

Pivotable connection 560 is designed to evenly distribute the downward force of piston rod 556 to the stock material in grooves 541. Without pivotable connection 560, the downward force of piston rod 556 might be transferred to the stock material in only one of the grooves with the result that the stock material in the other groove is not fed properly. Pivotable clamp 560 is known to those skilled in the art and, for example, can consist of a block and trunnion such as shown in FIGS. 1 and 6.

Slide block top part 511 and slide block bottom part 512 are connected by shoulder bolts 558, such that any horizontal movement of slide block bottom part 512 is immediately transmitted and causes the same horizontal movement of slide block top part 511. Shoulder bolts 558, however, permit vertical movement of slide block top part 511 relative to slide block bottom part 512. Thus, as piston rod 556 pushes downwardly, it causes slide block top part 511 to move downwardly until it engages slide block bottom part 512. Of course, if there is any stock material between slide block top part 511 and slide block bottom part 512, it is firmly held therebetween. By varying the pressure in compressed air cylinder 550, the downward force of piston rod 556 can be changed, thus varying the clamping pressure slide block top part 511 exerts on the stock material.

The relationship between shoulder bolts 558 and grooves 541 can be varied. For example, shoulder bolts 558 could be spaced further out with the grooves placed in between. This configuration would be desireable if the apparatus was also intended to be used on strip stock material.

If compressed air is released from compressed air cylinder 550, piston rod 556 may move in the upward direction causing housing 530 and slide block top part 511 to move in an upward direction away from slide block bottom part 512 thereby releasing any material clamped therein. In a preferred embodiment, a separate slide block release mechanism 650 is provided which overcomes the downward, clamping force of compressed air cylinder 550 and piston rod 556. Thus, the material can be released from clamping engagement with the slide block while compressed air cylinder 550 is maintained at a preselected pressure.

After moving horizontally and feeding a portion of stock material, slide block 510 experiences the first dwell period. During this first dwell period, a material clamp 600 is engaged. Then a separate slide block release mechanism 650 is activated which overcomes the downward force of piston rod 556 and moves the slide block top part 511 upward, releasing the stock material clamped in slide block 510.

Thereafter a second rotation occurs, during which slide block drive shaft 500 and gear 520 rotate in the opposite direction thereby moving slide block 510 back to its original position. Slide block top part 511 moves along slideable track 538 while slide block bottom part 512 moves along slideable track 532. Slide block top part 511 is not in clamping engagement with slide block bottom part 512 during this movement. The entire slide block 510, however, moves back to its original position while the feed material remains motionless between the top and bottom parts of slide block 510 because of the connection provided by shoulder bolts 558. Material clamp mechanism 600, which is still engaged, ensures that the stock material does not move.

Slide block 510 then experiences a second dwell period during which time slide block release mechanism 650 is disengaged, enabling piston rod 556 to force slide block top part 511 into engagement with slide block bottom part 512 clamping the stock material therebetween. Material clamp mechanism 600 is then released. The apparatus is then ready for the next feed cycle which begins with the advancing motion of slide block 510 thereby feeding the next length of stock material to the press.

Shown in the lower left-hand corner of FIG. 1 are cam 604 and cam followers 606 and 656 which activate material clamp mechanism 600 and slide block release mechanism 650. Cam follower 606 activates material clamping mechanism 600 while cam follower 656 activates slide block release mechanism 650. As shown in FIG. 2 cam 604 rotates at the same speed as cam shaft 280. Typically, this is accomplished by a set of connecting gears 592 and 594 between cam shaft 280 and release cam shaft 602. Connecting gears 592 and 594 and conventional bearing assemblies 596 and 598 are arranged and operate in a manner similar to the connection between input shaft 14 and cam shaft 280.

Figure 7:
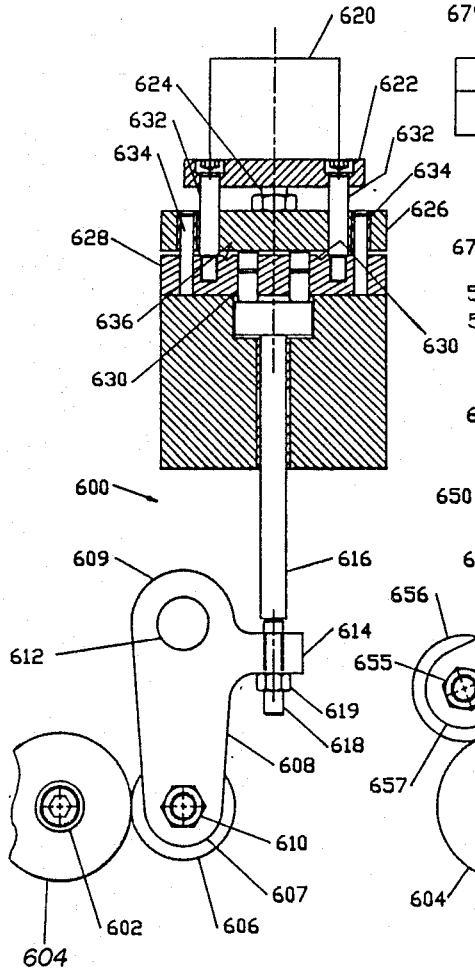
FIG. 7 is a partial front view of the embodiment shown in FIG. 6, illustrating the material clamp mechanism.
Figure 8:
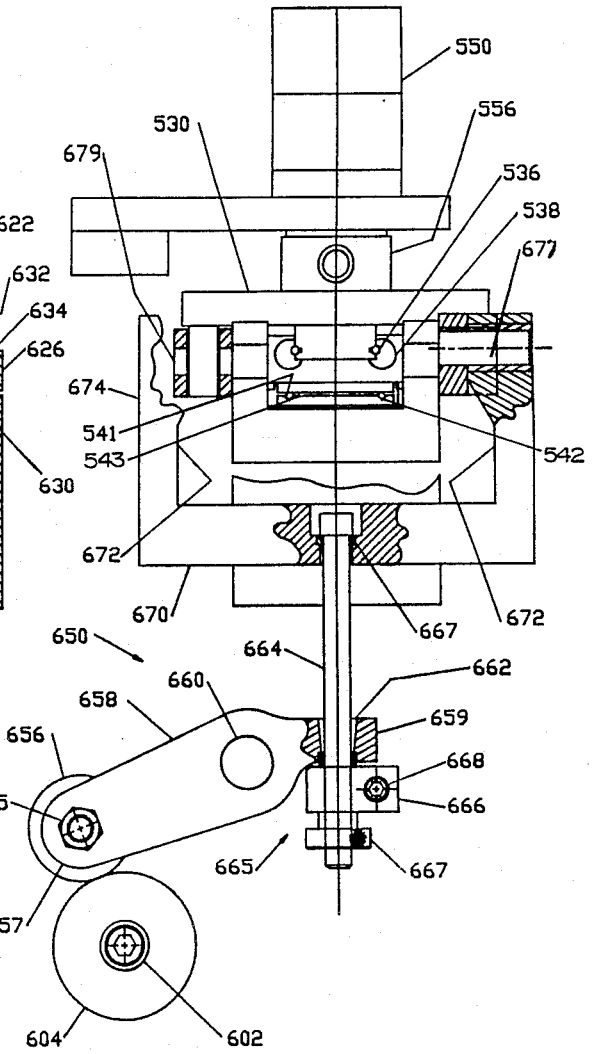
FIG. 8 is a partial front. view of the embodiment shown in FIG. 6, illustrating the slide block release mechanism.

FIG. 7 shows material clamp mechanism 600 while FIG. 8 shows slide release mechanism 650. FIG. 6 shows a side view of material clamp mechanism 600 and slide block release mechanism 650. Cam 604 having two cam surfaces 605 and 655, similar to cam 311 with its cam surfaces 312 and 314, is also shown.

The operation of material clamp mechanism 600 is best described in relation to FIGS. 6 and 7. As release cam shaft 602 rotates, cam 604 which is rigidly connected thereto rotates at the same speed. During part of its rotation, cam surface 605 pushes outwardly on cam follower 606. Cam follower 606 is rotatably connected to one end 607 of link 608 by pin 610. The other end 609 of link 608 is pivotally connected to shaft 612. Link 608 also has an arm portion 614 which is connected to an actuating member 616 by means of adjusting screw 618 and lock nut 619. When cam follower 606 is pushed outwardly, link 608 pivots about shaft 612 moving arm portion 614 in a generally upward direction thereby causing actuating member 616 to move in an upward direction.

As pictured in FIG. 7, material clamp mechanism 600 is normally in the closed or clamped position. This is because air cylinder 620 which is located on top of support 622 continually exerts a downward force through piston rod 624 causing upper block 626 to engage lower block 628 and thus hold the stock material therebetween.

Actuating member 616 pushes up on lift pins 630 which in turn press evenly on upper block 626. Since the upward force of actuating member 616 is large enough to overcome the downward force of piston rods 624, upper block 626 will be raised out of clamping engagement with lower block 628 and the stock material will be released.

Support 622 is connected to lower block 628 by means of shoulder bolts 632. Shoulder bolts 632 permit upper block 626 to slide up and down while guide pins 634 are connected between upper block 626 and lower block 628 to maintain them in alignment. Lower block 626 is also provided with grooves 636 to hold the stock material similar to those provided in slide block bottom part 512. Similarly, upper block 626 may also have grooves just like slide block top part 511.

When cam surface 605 no longer pushes cam follower 606 in an outward direction, cam follower 606 returns to its original position as shown in FIG. 7. Link 608 again pivots about shaft 612 returning arm portion 614 to its original position and moving actuating member 616 in a downward direction. There is no longer any upward force to overcome the downward force of air cylinder 620 and piston rod 624, whereupon, upper block 626 of material clamp mechanism 600 engages lower block 628 and clamps the material therebetween.

Adjusting screw 618 and lock nut 619 enable the material clamp mechanism to accommodate different sizes of feed material. As larger stock material is fed upper block 626 must be moved upward to accommodate it. Accordingly, actuating member 616 must be adjusted to remove any slack caused by this upward movement. Adjusting screw 618 and lock nut 619 permit the length of actuating member 616 to be adjusted to remove any slack in the connection thereby enabling the movement of cam follower 606 to be immediately transferred to upper block 626.

FIG. 8 shows the slide block release mechanism 650. Cam surface 655 during the first dwell period pushes outwardly on cam follower 656 which is rotatably connected to one end 657 of link 658 by pin 655. The other end of link 658 forms an arm member 659. Located between arm member 659 and end portion 657 is shaft 660. Link 658 is pivotally attached to shaft 660 such that when cam follower 656 moves in an outward direction, link 658 pivots about shaft 660 causing arm member 659 to move in a downward direction.

Arm member 659 has a hole 662 through which rod 664 passes. The bottom part 665 of rod 664 consists of a split clamp 666 and an adjustment knob 667. The bottom part of arm portion 659 rests on top of split clamp 666. When arm portion 659 moves in a downward direction, it pushes against split clamp 666 causing rod 664 to move in a downward direction. The hold 662 through arm member 659 is larger than rod 664 to allow for the pivoting action of arm member 659.

Split clamp 666 and adjustment knob 667 are used to adjust slide block release mechanism 650 to accommodate different sizes of stock material. Small variations in the positioning of arm portion 659 with regard to rod 664 are necessary when different sizes of stock material are fed. Clamp screw 668 releases split clamp 666. Adjustment knob 667 then threadingly moves split clamp 666 up or down on rod 664 until split clamp 666 rests snugly against arm portion 659 such that there is no play in the linkage. Clamp screw 668 is then tightened to keep split clamp 666 in position.

The other end 667 of rod 664 is connected to yoke 670. Yoke 670 is generally U-shaped with the distance between upright arm members 672 being wider that slide block 510. Upper end 674 of each arm member 672 is pivotally attached to one end 676 of bar member 678 by pin 677 as shown in FIG. 6. The other end of bar member 678 rides against housing 530. Between the ends of bar member 678 is drilled a hold 680 through which shaft 682 runs such that bar member 678 pivots around shaft 682.

As rod 664 moves downwardly, yoke 670 pulls down on end 676 of bar member 678. Bar member 678 pivots about shaft 682 and lifts housing 530. Housing 530 is turn lifts slide block top part 511 releasing the material from clamping engagement in slide block 510.

When cam surface 655 no longer pushes cam follower 656 outwardly, cam follower 656 returns to its original position thereby pivoting link 658 about shaft 660 and moving arm member 659 in an upward direction. This removes the force on rod 664 and housing 530. With no opposing upward force from housing 530, the downward pressure of piston rod 556 from compressed air cylinder 550 returns slide block part 511 into engagement with slide block lower part 512 thereby clamping the material. This in turn causes end 676 of bar member 678 to pivot about shaft 682 and moves yoke 670 and thereby rod 664 in an upward direction until it again rests against arm member 659.

While presently preferred embodiments of the invention have been described and shown in the drawings with particularity, the invention may be otherwise embodied within the scope of the appended claims.

What is claimed is:

1. An apparatus for intermittently feeding stock material comprising:

a cam shaft rotatable at a continuous preselected speed, an output shaft having a first end portion and a second end portion, a cam drive means connecting said output shaft first end portion to the cam shaft for generating intermittent oscillating rotational movement of the output shaft through a preselected angle of rotation, a slide block mounted in a housing and connected to a slide block drive shaft for intermittently feeding a preselected length of stock material, the slide block comprising: a slide block bottom portion slideably mounted on first tracks; a slide block top portion, slideable mounted on second tracks in the housing, and being disposed above the slide block bottom portion such that the stock material may be clamped therebetween by means of the housing; a rack secured to the base of the slide block bottom portion and a gear nonrotatably fixed on the drive shaft which drivingly engages the rack, and a linkage mechanism connected between the output shaft second end portion and the slide block drive shaft, wherein the linkage mechanism transmits the intermittent oscillating rotational movement of the output shaft to the slide block drive shaft which through the rack and gear causes a reciprocating horizontal movement of the slide block with predetermined dwell periods to intermittently advance a preselected length of stock material.

2. The apparatus as described in claim 1, wherein the linkage mechanism comprises a plurality of meshing gears.

3. The apparatus as described in claim 1, wherein the linkage mechanism is adjustable to feed different lengths of stock material.

4. The apparatus as described in claim 3, wherein the linkage mechanism comprises:

an adjustable throw block nonrotatably secured to the second end portion of the output shaft having a longitudinally moveable slide portion connected to an adjusting means, and a plurality of meshing gears connected between the throw block and the slide block drive means.

5. The apparatus as described in claim 3, wherein the linkage mechanism comprises:

an adjustable throw block nonrotatably secured to the second end portion of the output shaft having a longitudinally moveable slide portion connected to an adjusting means, a link nonrotatably fixed to the slide block drive means, and a transfer arm connected between the throw block and the link.

6. The apparatus as described in claim 1, wherein the apparatus further comprises: a piston means pivotably connected to the housing such that a downward movement of the piston means is evenly distributed through the housing and the slide block top portion to the stock material.

7. The apparatus as described in claim 6, wherein the slide block comprises:

a material clamp drivingly connected to the cam shaft for securing the stock material during a dwell period to prevent movement thereof, and a slide block release mechanism for moving the stock material out of clamping engagement with the slide block during a dwell period.

8. The apparatus as described in claim 7, wherein the stock material is a wire or a bar.

9. The apparatus as described in claim 1, further comprising:

a material clamp drivingly connected to the cam shaft for securing the stock material during a dwell period to prevent movement thereof.

10. The apparatus as described in claim 9, further comprising:

a slide block release mechanism for moving the stock material out of clamping engagement with the slide block during a dwell period.

* * * * *